US005647383A

United States Patent [19]

Brodof et al.

[11] Patent Number: 5,647,383

[45] Date of Patent: Jul. 15, 1997

[54] PHOTODEGRADABLE CELLULOSE ESTER TOW

[75] Inventors: Terry A. Brodof, Charlotte; John B. Hopkins, Jr., Pineville, both of N.C.

[73] Assignee: Hoechst Celanese Corporation, Somerville, N.J.

[21] Appl. No.: 559,393

[22] Filed: Nov. 15, 1995

Related U.S. Application Data

[62] Division of Ser. No. 404,477, Mar. 14, 1995, Pat. No. 5,491,024.

[51] Int. Cl.[6] ..... A24D 3/10

[52] U.S. Cl. ..... 131/331; 131/342; 131/345

[58] Field of Search ..... 131/331, 332, 131/334, 335, 341, 342, 345; 428/372, 393; 106/193, 204, 428

[56] References Cited

U.S. PATENT DOCUMENTS

| | | | |
|---|---|---|---|
| 2,750,653 | 6/1956 | White . | |
| 3,669,896 | 6/1972 | Preininger et al. . | |
| 3,675,541 | 7/1972 | Tokitomo et al. . | |
| 4,022,632 | 5/1977 | Newland et al. . | |
| 4,193,412 | 3/1980 | Heim et al. | 131/342 |
| 5,025,815 | 6/1991 | Hill et al. | 131/332 |
| 5,242,880 | 9/1993 | Irick, Jr. . | |
| 5,427,852 | 6/1995 | Teufel et al. . | |
| 5,449,555 | 9/1995 | Karstens et al. . | |
| 5,462,801 | 10/1995 | Willmund | 131/342 X |

FOREIGN PATENT DOCUMENTS

| | | |
|---|---|---|
| 597 478 A1 | 5/1994 | European Pat. Off. . |
| WO 93/24685 | 12/1993 | WIPO . |

OTHER PUBLICATIONS

Kirk–Othmer, *Encyclopedia of Chemical Technology,* 3rd Edition, vol. 5, John Wiley & Sons, New York, NY 1979, p. 90.

Rabaek, J. F., *Mechanisms of Photophysical Processes and Photochemical Reactions in Polymers,* John Wiley & Sons, New York City, NY 1987, pp. 585–587.

Kemira, Inc., The Savannah Story (publication date unknown).

Meldrum, B. J., "Fine Particle $TiO_2$—A Brief Introduction", ANTEC (1991) pp. 5–8.

AATCC Test Method 169–1990, "Weather Resistance of Textiles: Xenon Lamp Exposure" AATCC Test Method 177–1993, Colorfastness to Light at Elevated Temperature and Humidity: Water Cooled Xenon Lamp Appartus.

Product Brochures—UV Titan, Tipaque, and Tioxide Chemicals (publication dates unknown).

Brown, C. L. "The Design of Cigarettes", Hoechst Celanese Corporation, Charlotte, NC 1990 pp. 59–64.

*Cellulose Chemistry and Its Applications,* Ellis Harwood, Ltd., Chichester, England, 1985, pp. 474–476.

Product Brochure—Micro Titanium Dioxide (publication date unknown).

*Primary Examiner*—Jennifer Bahr
*Attorney, Agent, or Firm*—Robert H. Hammer, III; Miles B. Dearth

[57] ABSTRACT

The present invention is directed to a man-made fiber comprising a cellulose ester and 0.05 to 5.0% by weight of a titanium dioxide having an average particle size of less than 100 nanometers.

5 Claims, No Drawings

PHOTODEGRADABLE CELLULOSE ESTER TOW

This is a division of Ser. N. 08/404,477, filed Mar. 14, 1995 now U.S. Pat. No. 5,491,024.

FIELD OF THE INVENTION

This invention is directed to a photodegradable cellulose ester tow.

BACKGROUND OF THE INVENTION

Cellulose ester tow is known. Kirk-Othmer, *Encyclopedia of Chemical Technology,* 4th Edition, Vol. 5, John Wiley & Sons, New York, N.Y., 1993, p. 496–529. Cellulose acetate tow is known. Kirk-Othmer, *Encyclopedia of Chemical Technology,* 3rd Edition, Vol. 5, John Wiley & Sons, New York, N.Y., 1979, p. 89–117, Cellulose acetate tow impregnated with titanium dioxide pigments, either anatase or rutile, as a delustrant is known. See: Kirk-Othmer, Ibid, 3rd Edition, p. 90; and U.S. Pat. No. 4,022,632, The ideal delustering titanium dioxide pigment has a particle size ranging from 200 to 350 nm (0.2 to 0.35 microns). See: Undated publication of Kemira, Inc. entitled "The Savannah Story". These pigments are typically coated to retard their photocatalytic effect. Rabek, J. F., *Mechanisms of Photophysical Processes and Photochemical Reactions in Polymers*, John Wiley & Sons, New York City, N.Y., 1987, p. 585–587.

It has been proposed that anatase-type titanium dioxides can be used to accelerate the photodegradation of cellulose ester tows. See: EPO Publication No. 597,478; WO 93/24685; and U.S. Pat. No. 5,242,880, These photodegradable cellulose ester tows utilize uncoated anatases. *Ibid.* As a photodegradability accelerator, anatase-type titanium dioxide is better than rutile-type titanium dioxide. In EPO Publication No. 597,478, the cellulose ester tow has about 0–5% by weight of an anatase-type titanium dioxide having an average particle diameter of about 300 nm (0.3 microns), a particle size distribution of 10–1000 nm (0.01–1 micron), and specific surface area of 3 to 30 $m^2/g$. In WO 93/24685, the average particle size is given by reference to the exemplary photoactive anatase titanium dioxides set forth in Table 1 at page 48, Therein, three commercially available pigments are disclosed. Each is believed to have an average particle size of about 350 nm (0.35 microns). In U.S. Pat. No. 5,242,880, an oxidizable polymer such as cellulose acetate or polypropylene, is impregnated with a photoactive catalyst to increase biodegradability. The photoactive catalyst comprises an anatase-type titanium dioxide containing or coated with a salt. The salt comprises between 2–30 weight percent of the catalyst.

Fine particle, crystalline titanium dioxides (8–210 nm or 0.008–0.210 micron) are known for use as photodegradants in plastics. See: Meldrum, B. J., "Fine Particle $TiO_2$—A Brief Introduction", *SPE 49th Annual Technical Conference Exhibits,* 1991. Therein, uncoated, fine particles of titanium dioxide are loaded into polypropylene film which is then exposed to ultraviolet radiation, so to demonstrate the photodegradation effect.

There is a need for photodegradable cellulose ester tows that can minimize the littering problem associated with the disposal of spent cigarettes, having filters made from cellulose esters tows, on roadsides and the like.

SUMMARY OF THE INVENTION

The present invention is directed to a man-made fiber comprising a cellulose ester and 0.05 to 5.0% by weight of a titanium dioxide having an average particle size of less than 100 nanometers (nm).

DETAILED DESCRIPTION OF THE INVENTION

The present invention is described in greater detail below.

The invention is a man-made fiber comprising a cellulose ester and 0.05 to 5.0% by weight of a titanium dioxide having an average particle size of less than 100 nanometers. When the cellulose ester is a cellulose acetate, having a degree of substitution of 1.5 to 2.7, the preferred weight range of titanium dioxide is 0.1 to 3.0%. These man-made fibers are adapted to photodegrade. Cellulose acetate fibers, having a degree of substitution 1.5 to 2.7, will substantially degrade in 300 hours or less. The basis for measuring "substantial degradation" is AATCC TEST METHOD 169-1990 as discussed in greater detail below. Preferably, substantial degradation refers to a tenacity of less than or equal to 0.2 grams/denier at 200 hours.

Cellulose ester refers to organic esters. Examples of such esters include: cellulose acetate; cellulose propionate; cellulose butyrate; cellulose acetate propionate; cellulose acetate butyrate; cellulose propionate butyrate; and the like; and combinations thereof. The cellulose esters useful in the present invention can be prepared by any known technique. See: Kirk-Othmer, *Encyclopedia of Chemical Technology,* 3rd Edition, Vol. 5, John Wiley & Sons, New York, N.Y., 1979, p. 89–129; and Libscomb, A. G., *Cellulose Acetate: Its Manufacture and Applications*, Ernest Benn, Ltd. London, GB, 1933, both are incorporated herein by reference. The cellulose esters of the present invention preferably have at least 2 anhydroglucose rings and most preferably have about 2 and 5,000 anhydroglucose rings. Also, such polymers typically have an inherent viscosity (IV) of about 0.2 to about 3.0 deciliters per gram, most preferably about 1 to 1.6, as measured at a temperature of 25° C. from a 0.5 gram sample and 100 ml of a 60/40 by weight solution of phenol/tetrachloroethane. In addition, the DS/AGU (degree of substitution per anhydroglycose unit) of the cellulose esters useful herein ranges from about 1.5 to about 2.7, Cellulose acetates having a DS/AGU of 1.7 to 2.6 are especially preferred. The most preferred cellulose acetate has a DS/AGU of 1.8 to 2.2 and an IV of 1.3 to 1.5.

Any known, conventional additives to cellulose ester tow maybe incorporated into the inventive tows set forth herein. For example, delustrants (e.g., titanium dioxide) and spin finishes may be added, as is well known.

Titanium dioxide, as used herein, refers to any titanium dioxide material having an average particle size less than 100 nanometers. These titanium dioxides may also have a specific surface area of greater than 50 $m^2/g$. Materials of this type are commercially available from: Sachtleben Chemie GmbH, Duisburg, Germany under the trade name "HOMBIFINE N"; Kemira Group, Pori, Finland under the tradename "UV-Titan"; Ishihara Corporation, San Francisco, Calif., USA under the tradename TIPAQUE® titanium dioxide TTO-55 and TTO-51 Series; Tioxide Chemicals Ltd., Billingham, Cleveland, Great Britain under the trade designation of "UF".

Preferably, the titanium dioxide is an uncoated anatase material having an average particle size less 10 nanometers and a specific surface are of about 250 $m^2/g$. Uncoated refers to the absence of the coatings of inorganic materials used to retard the photocatalytic effect of many commercial titanium dioxides. See: Rabek, J., *Ibid.*, p. 257–259, incorporated herein by reference. Such inorganic coatings include, without limit: alumina, silica, zinc oxide, manganese acetate, silver acetate, thallium acetate, gallium acetate, ferric acetate, lead acetate, rubidium acetate, strontium acetate, aluminum acetate, lanthanum acetate, zirconium acetate, uranyl acetate, potassium acetate, samarium acetate, praseodymium acetate, niobium acetate, neodymium acetate, cupric acetate, magnesium acetate, barium acetate, yttrium acetate, sodium acetate, lithium acetate, chromic acetate, stannous acetate, didymium acetate, nikelous acetate, calcium acetate, cerous acetate, zinc acetate, cobaltous acetate, and manganous acetate.

The titanium dioxide is added to the "dope" (i.e., the solvated cellulose ester) prior to extrusion into the tow. Addition of the titanium dioxide may be at any convenient point prior to extrusion. No special preparation of the titanium dioxide is required, except that one should insure that agglomeration of the fine particles is minimized or reduced so that the photoactivity provided by the fine particles is maximized. Extrusion of the tow maybe accomplished, as is well known, in any conventional manner. See: Browne, C. L., *The Design of Cigarettes*, Hoechst Celanese Corporation, Charlotte, N.C., 1990, p. 59–64, incorporated herein by reference.

Cigarette, is used herein, refers to any commonly known cigarette comprising a tobacco column and a filter as those terms are commonly used in the industry. See: Browne, C. L., *The Design of Cigarettes*, Hoechst Celanese Corporation, Charlotte, N.C., 1990, incorporated herein by reference.

EXAMPLE

All yarn were prepared in a conventional manner. See: *Cellulose Chemistry And Its Applications*, Ellis Harwood Ltd., Chichester, England, 1985, p. 474–476, incorporated herein by reference. Cellulose acetate polymer is dissolved in a solvent of 96% acetone and 4% water. In all cases, 100 lbs of total solution prepared which contained 27 lbs of cellulose acetate polymer in 73 pounds of a 96%/4% acetone/water solvent. If titanium dioxide is added, it is done so after the polymer is dissolved in the solvent. The mixture is stirred until homogenous, and filtered. After filtering, yarn is extruded through a 190 hole spinnerette with a hole diameter of 52 μm. This results in a fiber with 2.9 denier/filament.

The yarns are evaluated according to the procedures of the American Association of Textile Chemist and Colorists (AATCC). AATCC Test Method 169–1990 "Weather Resistance of Textiles: Xenon Lamp Exposure", Option 1 is used. Yarns are prepared for evaluation according to AATCC Test Method 177-1993 "Colorfastness to Light at Elevated Temperature and Humidity: Water Cooled Xenon Lamp Apparatus".

The yarns are wrapped around a paper card and placed in a metal holder. The holder with the yarn is placed in an Atlas model C65 WeatherOmeter and subjected to alternating conditions of Xenon light exposure and water spray. Conditions (option 1) have been predetermined to equate to environmental conditions of South Florida. At 100 hours intervals, which roughly relate to one month outdoors exposure, yarns are removed, conditioned to ambient conditions and then breaking strength is measured.

Example 1

Yarn prepared as described above with the addition of 0.135 lbs of Kemira 0–310 pigment grade TiO2 (anatase) with a median diameter of 420 nm.

Example 2

Yarn prepared as described above with no added TiO2.

Example 3

Yarn prepare as described above with the addition of 0.135 lbs of Kemira 0–310 TiO2 (Anatase) plus 0.135 lbs of Hombifine N ultra fine grind TiO2 (Anatase) with a primary particle diameter of less than 10 nm.

Example 4

Yarn prepared as described above with the addition of 0.135 lbs of Hombifine N TiO2.

Example 5

Yarn prepared as described above with the addition of 0.27 lbs. of Hombifine N TiO2.

As Table 1 shows, yarns prepared with ultra fine TiO2, Examples 3, 4, and 5 disintegrate (breaking strength =0 grams/denier) quicker than yarns prepared with pigment grade TiO2, Example 1 or no TiO2 at all, Example 2, Even though Examples 3 and 4 both contained the same amount of ultra fine grind TiO2, Example 3, which also contained pigment grade TiO2, disintegrated slower that Example 4 which only contained the ultra fine grind TiO2. This is due to the light refractive characteristics of pigment grade TiO2.

TABLE 1

Tenacity (grams/denier) of various CA yarns exposed in the weatherometer

| SAMPLE | 0 Hrs | 100 Hrs | 200 Hrs | 300 Hrs |
|---|---|---|---|---|
| Example 1 0.5% PIGMENT GRADE Ti02 | 1.06 | 0.79 | 0.54 | 0.15 |
| Example 2 0.0% Ti02 | 1.14 | 0.68 | 0.53 | 0.14 |
| Example 3 0.5% ULTRA FINE Ti02 0.5% PIGMENT GRADE Ti02 | 1.06 | 0.46 | 0.14 | 0 |
| Example 4 0.5% ULTRA FINE Ti02 | 1.08 | 0.55 | 0.06 | 0 |
| Example 5 1.0% ULTRA FINE Ti02 | 1.05 | 0.28 | 0 | 0 |

We claim:

1. A cigarette comprising:

a tobacco column; and a filter comprising a man-made fiber comprising a mixture of a cellulose ester, and about 0.05 to 5.0% by weight of titanium dioxide having an average particle size of less than 100 nanometers.

2. A cigarette comprising:

a tobacco column, and a filter comprising a man-made fiber comprising a mixture of a cellulose acetate having a degree of substitution of 1.5 to 2.7, about 0.05 to 5.0% by weight of titanium dioxide having an average particle size of less than 100 nanometers; and being adapted to be substantially degraded, as measured by AATCC TEST METHOD 169-1990, in 300 hours or less.

3. The cigarette according to claim 2 wherein said titanium dioxide in said cellulose acetate ranges from about 0.1 to 3.05 by weight.

4. The cigarette according to claim 2 wherein substantially degraded means a tenacity of less than or equal to 0.2 grams/denier at 200 hours.

5. A cigarette comprising:

a tobacco column, and a filter comprising a man-made fiber comprising a mixture of a cellulose acetate having a degree of substitution of 1.5 to 2.7, about 0.05 to 5.0% by weight of titanium dioxide having an average particle size of less than 10 nanometers; and being adapted to be substantially degraded, as measured by AATCC TEST METHOD 169-1990, in 300 hours or less.

* * * * *

UNITED STATES PATENT AND TRADEMARK OFFICE

CERTIFICATE OF CORRECTION

PATENT NO. : 5,947,383
DATED : September 7, 1999
INVENTOR(S) : Faustmann

It is certified that error appears in the above-identified patent and that said Letters Patent is hereby corrected as shown below:

Title page,
Item [30], change "19718532" to read as -- 19718532.0-13 --.

Column 2,
Line 28, insert a comma after the word "deflection" to read as -- deflection, --.
Line 63, insert a comma after the word "calender" to read as -- calender, --.

Column 4,
Line 9, insert a comma after the word "plate" to read as -- plate, --.

Column 5,
Line 8, insert a period after "6" to read as -- 6. --.

Signed and Sealed this

Sixth Day of November, 2001

*Attest:*

Nicholas P. Godici

*Attesting Officer*

NICHOLAS P. GODICI
*Acting Director of the United States Patent and Trademark Office*